US010067473B2

(12) United States Patent
Carreno et al.

(10) Patent No.: US 10,067,473 B2
(45) Date of Patent: Sep. 4, 2018

(54) HOROLOGY CALENDAR SYSTEM

(71) Applicant: ROLEX SA, Geneva (CH)

(72) Inventors: William Carreno, Geneva (CH); Denis Rudaz, Segny (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 15/360,860

(22) Filed: Nov. 23, 2016

(65) Prior Publication Data

US 2017/0153603 A1 Jun. 1, 2017

(30) Foreign Application Priority Data

Nov. 26, 2015 (EP) ..... 15196613

(51) Int. Cl.
*G04B 19/247* (2006.01)
*G04B 19/253* (2006.01)
*G04B 19/04* (2006.01)

(52) U.S. Cl.
CPC ..... *G04B 19/247* (2013.01); *G04B 19/046* (2013.01); *G04B 19/2536* (2013.01); *G04B 19/2538* (2013.01)

(58) Field of Classification Search
CPC ... G04B 19/247; G04B 19/2536; G04B 19/24
USPC ..... 368/37
See application file for complete search history.

(56) References Cited

U.S. PATENT DOCUMENTS 2,764,828 A * 10/1956 Wolaver ..... G04B 19/2536 368/37
3,518,825 A * 7/1970 Nissen ..... G04B 19/25373 368/37
4,171,610 A 10/1979 Gilomen
4,228,644 A 10/1980 Watanabe et al.
5,289,437 A 2/1994 Leuenberger et al.
5,432,759 A 7/1995 Vaucher
6,108,278 A 8/2000 Rochat
6,744,696 B2 6/2004 Vernay et al.
7,366,058 B2 4/2008 Marki et al.
7,835,229 B2 11/2010 Chaignat
8,040,759 B2 10/2011 Chaignat
8,503,267 B2 * 8/2013 Philippine ..... G04B 19/25 368/28

(Continued)

FOREIGN PATENT DOCUMENTS

CH 681 673 B5 11/1993
CH 685 585 B5 2/1996

(Continued)

OTHER PUBLICATIONS

Stopwork—fhs.swiss/berner/?l=en—Jul. 31, 2018.*

(Continued)

*Primary Examiner* — Sean Kayes
(74) *Attorney, Agent, or Firm* — Westerman, Hattori, Daniels & Adrian, LLP

(57) ABSTRACT

A horology calendar system (100; 200) comprising: —a date display member (10) including an opening (10*a*); and —a month display member (30) arranged in such a way as to display an indication of the month in the opening (10*a*), notably when the opening (10*a*) is visible to a user of the calendar system and/or when the calendar system is indicating the first day of a given month.

23 Claims, 8 Drawing Sheets

(56) References Cited

U.S. PATENT DOCUMENTS

| | | | | |
|---|---|---|---|---|
| 8,509,035 | B2 * | 8/2013 | Philippine | G04B 19/25 368/28 |
| 8,842,500 | B2 | 9/2014 | Schmidt | |
| 9,367,039 | B2 | 6/2016 | Carreno et al. | |
| 9,612,577 | B2 * | 4/2017 | Lecher | G04B 19/16 |
| 2003/0151981 | A1 | 8/2003 | Vernay et al. | |
| 2005/0078558 | A1 | 4/2005 | Dalloz | |
| 2006/0098535 | A1 | 5/2006 | Marki et al. | |
| 2006/0120219 | A1 | 6/2006 | Ruefenacht | |
| 2006/0221773 | A1 | 10/2006 | Kuepfer et al. | |
| 2008/0094941 | A1 | 4/2008 | Pellaton | |
| 2009/0003139 | A1 | 1/2009 | Kuepfer et al. | |
| 2010/0103780 | A1 | 4/2010 | Chaignat | |
| 2012/0106301 | A1 * | 5/2012 | Philippine | G04B 19/24306 368/35 |
| 2012/0106302 | A1 * | 5/2012 | Philippine | G04B 19/24306 368/35 |
| 2012/0127835 | A1 | 5/2012 | Dubugnon et al. | |
| 2012/0213038 | A1 | 8/2012 | Schmidt | |
| 2013/0336096 | A1 * | 12/2013 | Grossenbacher | G04B 9/005 368/15 |
| 2015/0286189 | A1 | 10/2015 | Gruenig et al. | |

FOREIGN PATENT DOCUMENTS

| | | | |
|---|---|---|---|
| CH | 697 673 | B1 | 1/2009 |
| CH | 699 794 | A2 | 4/2010 |
| CH | 704 082 | A2 | 5/2012 |
| CH | 704 505 | A2 | 8/2012 |
| CH | 706 799 | A2 | 2/2014 |
| EP | 0 634 711 | A1 | 1/1995 |
| EP | 0 987 609 | A1 | 3/2000 |
| EP | 1 335 253 | A1 | 8/2003 |
| EP | 1 524 564 | A1 | 4/2005 |
| EP | 1 666 991 | A1 | 6/2006 |
| EP | 1 962 152 | A1 | 8/2008 |
| EP | 2 180 383 | A1 | 4/2010 |
| EP | 2 428 856 | A1 | 3/2012 |
| EP | 2 428 856 | B1 | 1/2014 |
| FR | 2 355 321 | A1 | 1/1978 |
| WO | 2004/066039 | A1 | 8/2004 |
| WO | 2004/114027 | A2 | 12/2004 |
| WO | 2015/062839 | A2 | 5/2015 |

OTHER PUBLICATIONS

Cross—fhs.swiss/berner/?l=en—Jul. 31, 2018.*

European Search Report and Written Opinion dated May 12, 2016 issued in corresponding application No. EP15196613; w/ English partial translation and partial machine translation (10 pages).

European Search Report and Written Opinion dated May 24, 2016 issued in application No. EP15196614, corresponding to co-pending U.S. Appl. No. 15/360,855; w/ English partial translation and partial machine translation (12 pages) (EP0987609 and EP1666991 cited in the ESR and Specification, and EP2428856 and CH681673 cited in the Specification of the co-pending application are not listed in this IDS form since they are already listed in an IDS form filed concurrently).

Office Action dated Nov. 17, 2017 in co-pending U.S. Appl. No. 15/360,855; with PTO892; without returned SB08 (14 pages).

European Search Report and Written Opinion dated May 11, 2016 issued in application No. EP15196611 corresponding to co-pending U.S. Appl. No. 15/360,867; w/ English partial translation and partial machine translation (12 pages) (EP2428856 cited in the ISR and EP0987609 cited in the Specification of the co-pending application are not listed in this IDS form since they are already listed in an IDS form filed concurrently).

Office Action dated Feb. 16, 2018 in co-pending U.S. Appl. No. 15/360,867; with PTO892; without returned SB08 (10 pages).

Office Action dated Jul. 16, 2018 in co-pending U.S. Appl. No. 15/360,855; without returned SB08 (20 pages).

* cited by examiner

HOROLOGY CALENDAR SYSTEM

This application claims priority of European patent application No. EP15196613.2 filed Nov. 26, 2015, which is hereby incorporated by reference herein in its entirety.

The invention relates to a horology calendar system. It also relates to a horology movement comprising such a calendar system. It finally relates to a timepiece, notably a wristwatch, comprising such a system or such a movement.

Patent EP2428856B1 discloses a display device for indicating the month, in which the markings on a month disk are designed to collaborate with one of the twelve apertures of the dial. Although visually instantaneous, the mechanism is driven in several steps, thereby minimizing the energy needed for the month jump and distributing it over several days, thus making it possible to ensure the chronometric precision of the watch. Although this permanent display indicating the month is particularly discreet, it does, however, require the timepiece dial to have a very particular appearance.

Patent CH681673B5 proposes a device for the occasional displaying of time information, in which device an electrooptical display member is provided so as to appear, at the demand of the wearer, in a window of the date disk or of the day disk, which is situated between two pieces of calendar information. In a preferred embodiment, the concealed information corresponds to the month number, it being possible for this to appear for example when setting an annual or perpetual calendar. This device has the advantage of being particularly discreet, although on the other hand it does require complex actuating means which need to be programmed in such a way that they can allow the date disk or the day disk to be driven by one angular step or by two according to the angular position of the window. These are, for example, electronic means. Moreover, no kinematic connection between the date or day disks and the display member is proposed, the latter being fixed.

Patent application EP0987609 describes an annual calendar mechanism which is provided with a first kinematic chain driving the date disk and with a second chain for correcting the date disk which is operated under the impetus of a month cam. For this purpose, the date disk has three distinct toothsets. A first toothset, made up of thirty-one teeth, is designed to be driven in the conventional way by a date drive wheel. A second toothset, made up of one tooth, is designed to be driven by a date correction wheel. A third toothset, made up of one tooth, is designed to drive a month cam bearing a member for permanently displaying the month indication when passing from the thirty-first day of the current month to the first day of the next month.

Patent application EP1666991 discloses a trailing annual calendar mechanism which is provided with a month wheel that is intended to be driven at the end of a short month by an additional tooth of the date disk when passing from the thirtieth to the "thirty-first", and by an additional finger of the date wheel when passing from the "thirty-first" to the first day of the next month. This solution offers the advantage of using a date disk which is particularly simple, provided only with two distinct sets of teeth. However, such sequencing requires a complex mechanism, in which the driving of the month wheel is rendered possible by the fact that the calendar is a trailing calendar. The synchronized driving of each of the elements, notably of the date disk and of the month wheel, in fact causes the device to lock up. It is therefore not possible to succeed in operating an annual calendar with an instantaneous jump of date on the basis of such a mechanism. Moreover, the month wheel bears a member for permanently displaying the month indication. The double jump of the month wheel requires duplication of the month indication and therefore a shrinking of the month indicator, something which may create an unattractive appearance on the dial.

It is an object of the invention to provide a calendar system that makes it possible to overcome the disadvantages mentioned hereinabove and improve the horology calendar devices known from the prior art. In particular, according to a first aspect, the invention proposes a horology calendar system that has a structure that is simple and reliable while at the same time allowing the month to be displayed, at least occasionally. Moreover, according to a second aspect, the invention proposes an annual or perpetual horology calendar system in which a month cam is driven by a date wheel through the interposition of a kinematic connection element.

According to a first aspect of the invention, the horology calendar system comprises:

- a date display member comprising an opening; and
- a month display member arranged in such a way as to display an indication of the month in the opening, notably when the opening is visible to a user of the calendar system and/or when the calendar system is indicating a given day of a given month, notably the first day of the given month.

The horology calendar system may comprise a drive element for driving the month display member arranged to drive the month display member while the month display member and/or the opening is not visible to the user, notably arranged to drive the month display member between the second and the thirtieth day of the month indicated by the calendar system, particularly between the tenth and the twentieth day of the month indicated by the calendar system.

The horology calendar system may comprise a drive element for driving the month display member arranged to drive the month display member by one step while the date display member is driven by one step.

The drive element may comprise a date wheel provided with at least one tooth meshing with several teeth of a month wheel, particularly one tooth meshing with twelve teeth of the month wheel.

The drive element may comprise a kinematic connection element connecting the date display member to the month display member, the connection element being arranged to drive the month display member by at most 1/n of a step while the date display member is driven by one step, where n is a natural integer greater than 1, notably n=2 or n=3 or n=4 or n=5.

The connection element may comprise a Maltese cross provided with projections collaborating with n teeth of a date wheel, the Maltese cross having a toothset meshing with n teeth of a month wheel. Alternatively, the kinematic connection element may comprise a device including one or more intermediate wheels meshing with the month cam and meshing with a date wheel.

The date display member and the month display member may be pivoted about one and the same axis, and/or a date wheel and a month wheel may be pivoted about one and the same axis.

The date display member may be a date wheel and/or the month display member may be a month wheel.

The date display member and/or the month display member may be disks or annular portions of disks.

The horology calendar system may comprise a dial equipped with an aperture for displaying the days of the month, in which aperture the opening is arranged to appear.

The horology calendar system may be of the instantaneous-jump type.

At least one tooth of a date wheel may be arranged to allow the date display member an additional jump at the end of a month comprising fewer than thirty days and/or at the end of a thirty-day month.

A month wheel may comprise a cam for programming an annual or perpetual calendar.

According to the first aspect of the invention, a horology movement comprises a calendar system as defined hereinabove.

According to the first aspect of the invention, a timepiece, particularly a wristwatch, comprises a calendar system as defined hereinabove or a movement as defined hereinabove.

According to a second aspect of the invention, a horology calendar system comprises:

a date wheel;

a month cam; and a kinematic connection element arranged such that the date wheel allows the driving of the motion of the month cam.

The driving of the motion of the month cam may be performed exclusively by the date wheel, notably via the kinematic connection element, and/or the date wheel may comprise a date display member, particularly a date display disk.

The month cam may include a month display member, particularly a month display disk, or the month cam may be secured to a month display member, particularly a month display disk.

The kinematic connection element may be arranged to allow the driving of the month cam by one step, particularly by one twelfth of a revolution, over the course of one month.

The kinematic connection element may be arranged to allow the driving of the month cam by at most 1/n of a step while the date wheel is driven by one step, where n is a natural integer greater than 1, notably n=2 or n=3 or n=4 or n=5.

The kinematic connection element may be arranged to drive the month cam while the month display member is not visible to the user or does not display information and/or may be arranged to drive the month cam between the second and the thirtieth day of the month indicated by the calendar system, particularly between the tenth and the twentieth day of the month indicated by the calendar system.

The kinematic connection element may comprise a Maltese cross provided with protrusions collaborating with n teeth of the date wheel, the Maltese cross having a toothset meshing with the month cam.

The kinematic connection element may comprise a device including one or more intermediate wheel meshing with the month cam and meshing with the date wheel.

The date wheel and the month cam may be pivoted about one and the same axis.

The horology calendar system may be of the instantaneous-jump type.

The month cam may be of the annular type and/or the month cam may be provided with a cam surface arranged at the interior or exterior periphery.

The month cam may be arranged in such a way as to define:

a first state of the calendar system in which, while the date wheel is in a position for indicating the date "30", an action of a drive element of the calendar system causes the date wheel to advance by two steps; and a second state of the calendar system in which, while the date wheel is in a position for indicating the date "30", an action of the drive element of the calendar system causes the date wheel to advance by one step.

According to the second aspect of the invention, a horology movement comprises a calendar system as defined hereinabove.

According to the second aspect of the invention, a timepiece, particularly a wristwatch, comprises a calendar system as defined hereinabove or a movement as defined hereinabove.

According to the second aspect of the invention, a method of operation of a horology calendar as defined hereinabove or of a horology movement comprising a horology calendar system as defined hereinabove or of a timepiece comprising a horology calendar system as defined hereinabove comprises the following steps:

Positioning the month cam in a first position defining a first state of the calendar system in which, while the date wheel is in a position for indicating the date "30", an action of a drive element of the calendar system causes the date wheel to advance by two steps; and Positioning the month cam in a second position defining a second state of the calendar system in which, while the date wheel is in a position for indicating the date "30", an action of the drive element of the calendar system causes the date wheel to advance by one step.

Unless they are logically or technically incompatible, any combination of features from the first aspect of the invention can be combined with any combination of features from the second aspect.

For preference, the invention relates to a calendar system of which the device for displaying the month indication is provided with a member for displaying the month indication which has the specific feature of being visible to the wearer only occasionally, for example when displaying a particular day of the month, notably for phases of setting the calendar system.

The calendar system notably has the particular feature of at least partially driving the display member for displaying the month indication between the first and the thirty-first day of a current month.

Such a system offers an advantageous alternative to the devices that permanently display the month indication, which may overload the dial of a timepiece. Such a system also makes it possible to simplify the construction of a movement of the annual date or perpetual date type. In one particular embodiment, the system also makes it possible to minimize the energy required for driving the member that displays the month indication or a month cam and distribute it.

For preference therefore, in the calendar system, the month display member is visible only in a predetermined configuration of the date display member, for example on the first of a given month, and/or the month display member is driven, at least in part, between the first and the thirty-first day of a current month.

Such an occasional display of the month indication in fact has the advantage of allowing the month display wheel to be at least partially out of synchronization with the date display wheel, making it possible to simplify and/or optimize the construction of an annual or perpetual date calendar system in which the month wheel is kinematically connected to the date wheel, particularly in which the month wheel is only kinematically connected to the date wheel. Such a calendar system notably makes it possible to offer a particularly simple structure of date wheel in which the wheel is provided with only two separate sets of teeth.

The attached drawings depict, by way of examples, two embodiments of horology calendar systems according to the invention.

Figure 1:
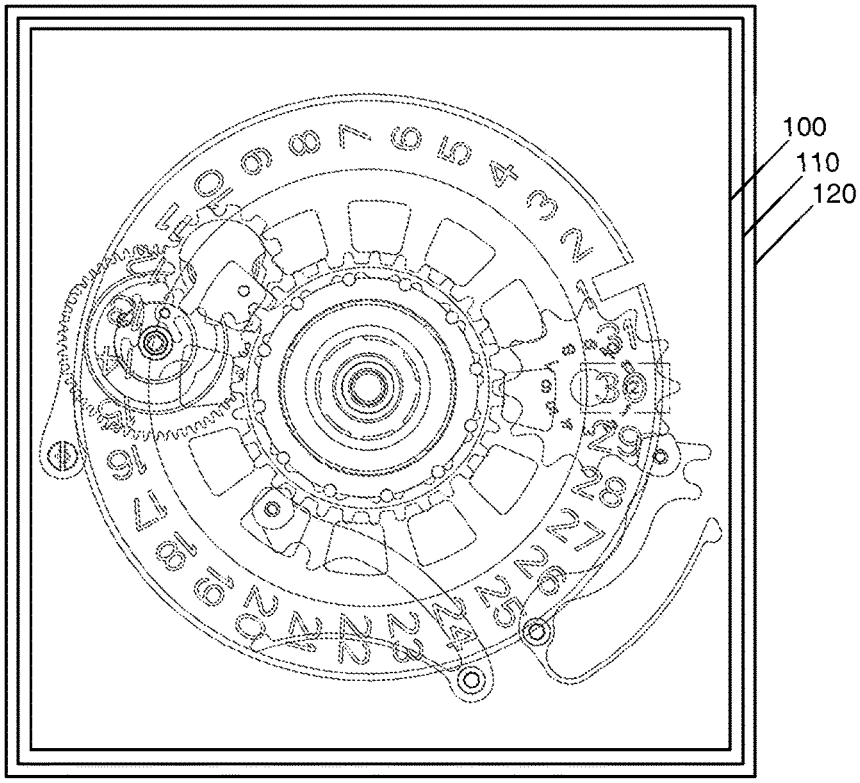
FIGS. 1 to 10 depict a first embodiment of a horology calendar system according to the invention.

A first aspect of the invention is illustrated by a first embodiment of a timepiece 120 which is described hereinafter with reference to FIGS. 1 to 10. The timepiece is, for example, a wristwatch.

The timepiece may comprise a horology movement 110, notably a mechanical movement.

The horology movement comprises a first embodiment of a calendar system 100 according to the invention. Advantageously, the calendar system is of the annual date or even perpetual date type.

The horology calendar system 100 comprises:

a date display member 10 comprising an opening 10*a*, and a month display member 30 arranged in such a way as to display an indication of the month in the opening 10*a*, notably when the opening 10*a* is visible to a user of the calendar system and/or when the calendar system is indicating the first day of a given month.

For preference, the opening 10*a* is a first aperture facing a date indication or juxtaposed with a date indication, particularly facing the date "1" or juxtaposed with the date "1". In the first embodiment described, the opening 10*a* is therefore juxtaposed with the indication of the first day of the month. It is, of course, possible, to position the opening 10*a* facing a different date.

For preference also, the month display member 30 or month indicator member is arranged in such a way as to display an indication of the month in the opening 10*a* when the calendar system is indicating the first day of a given month.

In the first embodiment, the month display wheel is actuated over one single solitary angular step of the date disk performed between the first and thirty-first day of a current month.

Figure 2:
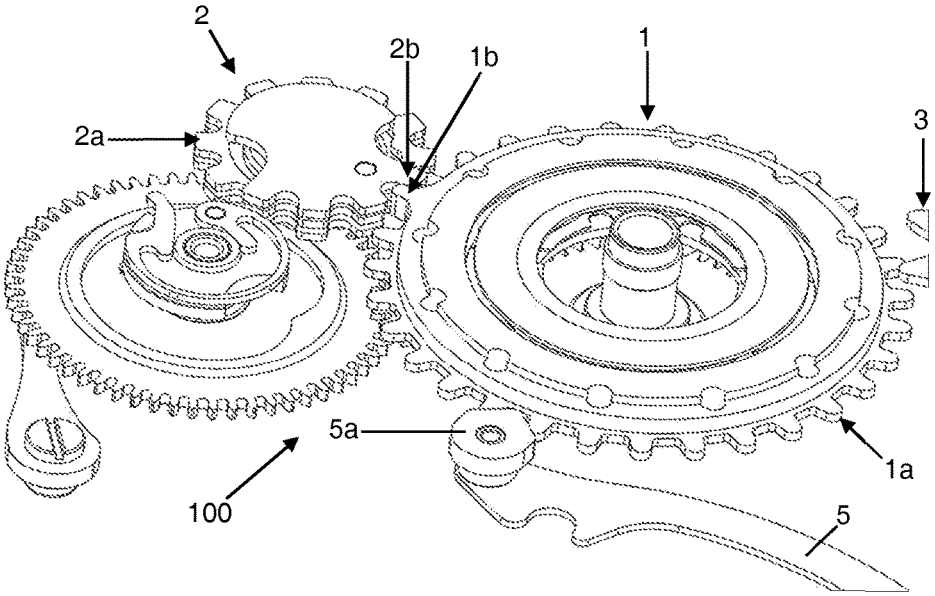
Figure 3:
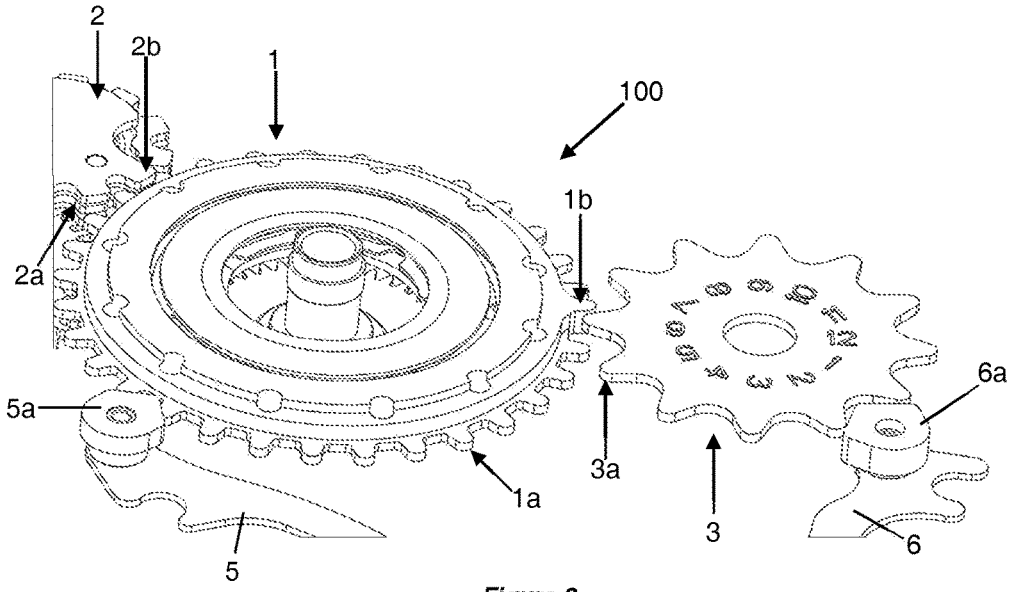

The first embodiment has the particular feature of being provided with a date wheel 1 which comprises a first external toothset 1*a* designed to mesh with a toothset 2*a* of a programming assembly 2. The date wheel 1 has a toothset 1*b* which is reduced to one tooth 1*b* intended to mesh both with a toothset 2*b* of the programming assembly 2 as depicted in FIG. 2 and with a toothset 3*a* of a month wheel 3 as depicted in FIG. 3. The toothsets 1*a* and 1*b* are in this instance arranged on two distinct levels.

Figure 4:
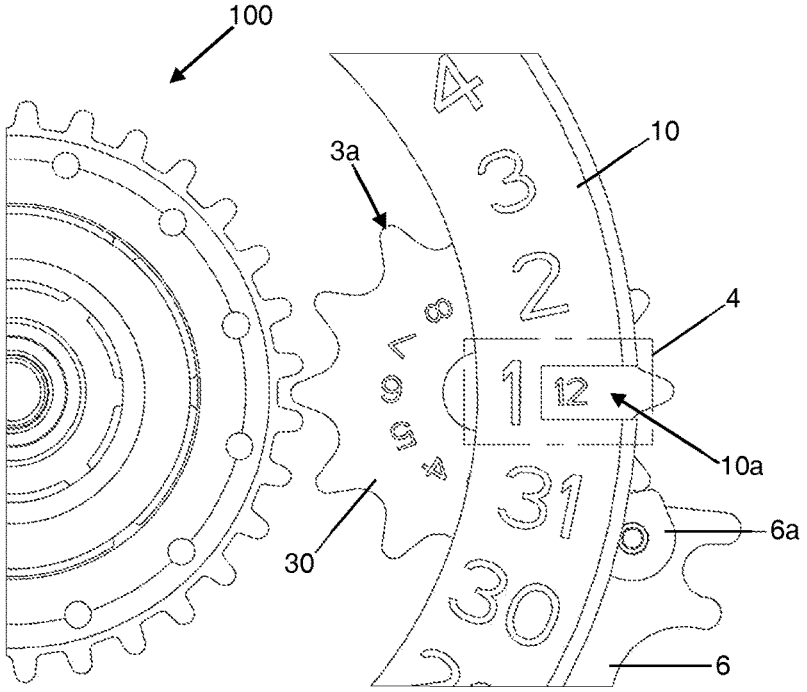

The date display member 10 or date indicating member is arranged above the month indicating member 30. Thus, as long as the opening 10*a* formed on the member 10 is not arranged facing the second aperture 4 as depicted in FIG. 4, the month indication is not visible to the user through a glass of the timepiece and notably through a second aperture 4 made, for example, in a dial 99 (depicted partially in FIG. 6). In order to achieve this, the horology calendar system may include the dial equipped with the second date display aperture in which the opening is arranged in order to appear.

During the phases of immobilization of the wheels 1 and 3, these are indexed in the conventional way using jumpers 5, 6 of which the heads or the beaks 5*a*, 6*a* are respectively designed to collaborate with the toothsets 1*a* and 3*a* as depicted in FIG. 3.

Figure 5:
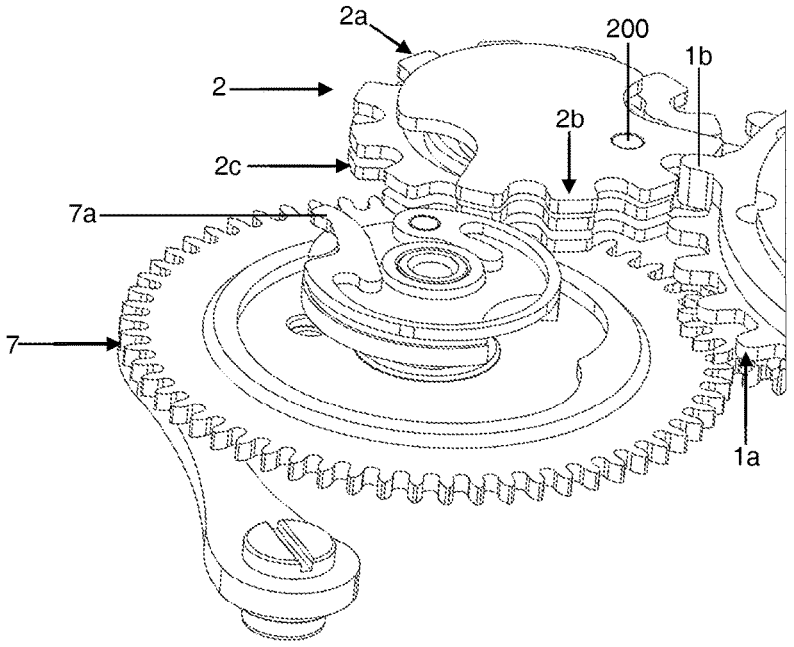

The assembly 2 is arranged in such a way that the calendar system distinguishes long months from short months. To do that, the toothsets 2*a*, 2*b* of the assembly 2 are both designed to be actuated, every day, by a drive element 7 of the calendar system which is provided with two drive fingers 7*a*, 7*b* each of which is devoted to the driving of the toothsets 2*a*, 2*b*. The finger 7*b* actuates the toothset 2*b* via a toothset 2*c*, these two toothsets 2*b* and 2*c* rotating as one as a result of a pin 200 as shown in FIG. 5.

Figure 6:
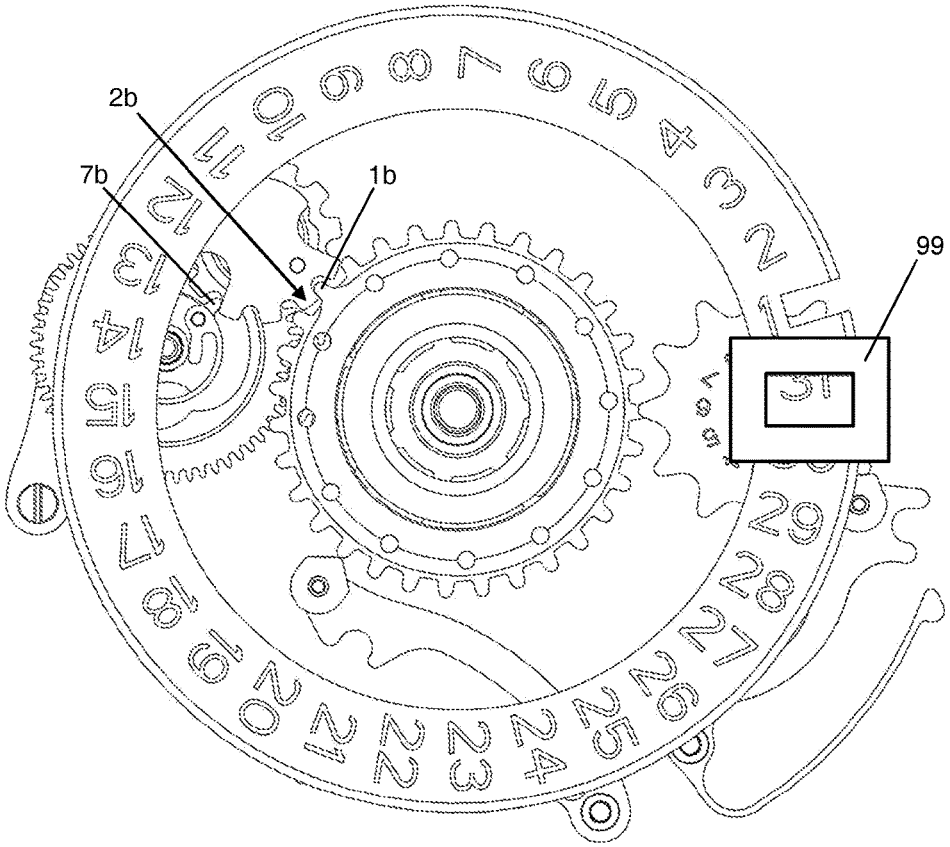
Figure 7:
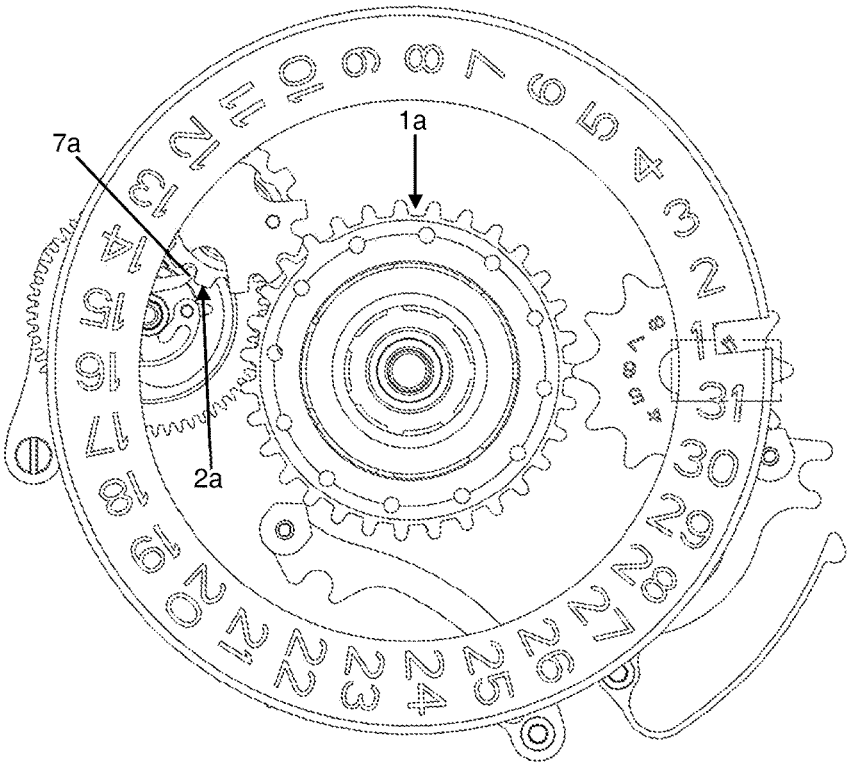
Figure 8:
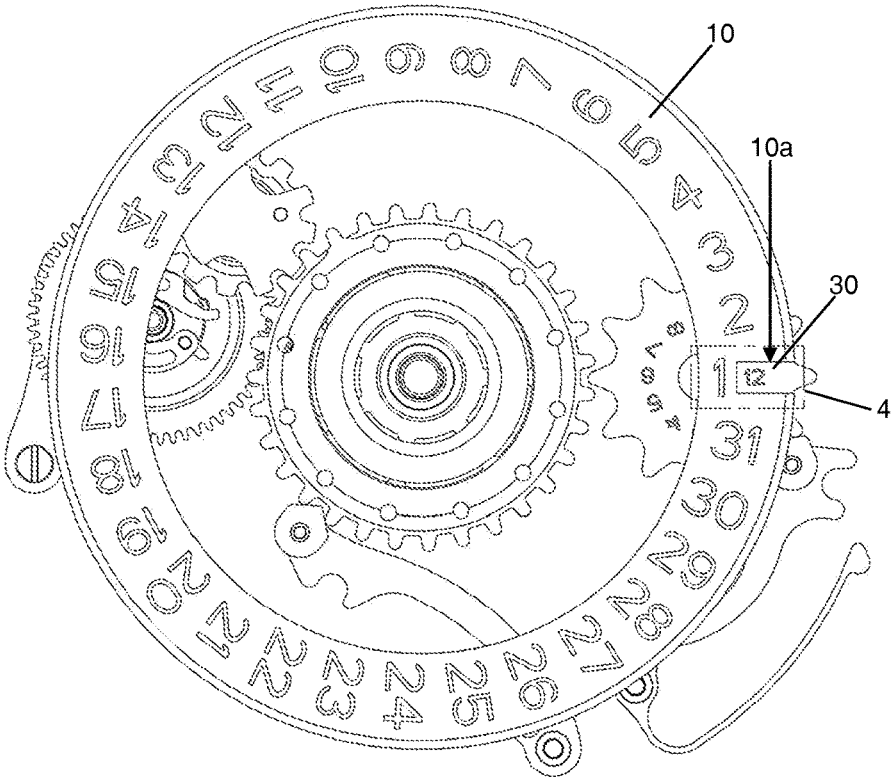

Interaction between a tooth of the toothset 2*a* of the assembly 2 and a tooth of the toothset 1*a* of the wheel 1 occurs at each change of date. By contrast, interaction between one tooth of the toothset 2*b* of the assembly 2 and the tooth 1*b* of the wheel 1 occurs only at the end of each short month, more particularly during the transition of the display from the thirtieth to the "thirty-first" day of each short month. By way of example, FIGS. 6 to 8 illustrate the mechanism at the end of the month of November. FIG. 6 depicts the state of the calendar system during the transition in display from the thirtieth to the "thirty-first" day. In this configuration, the finger 7*b* leads the toothset 2*b* which actuates the tooth 1*b* over a first angular step of the date wheel. FIG. 7 depicts the state of the calendar system during the transition in display from the thirty-first day of the month to the first day of the month of December. In this configuration, the finger 7*a* leads the toothset 2*a* which actuates the toothset 1*a* over a second angular step of the date wheel. Thus, for an action, notably a revolution, of the drive element 7 of the calendar system, the date wheel 1 has advanced by two steps, as has the date display member 10 which has moved on from a state displaying "30" to a state displaying "1". In consequence, the system comprises at least one tooth 1*b* of the date wheel 1 which is arranged to allow the date display member 10 an additional jump at the end of a thirty-day month. FIG. 8 illustrates the final state of the calendar system after the two transitions described above.

During these phases of changing the date at the end of the month, it is noted that the month wheel 3, particularly the month display member 30, remains immobile. It may be noted that, in the operating sequence illustrated in FIGS. 6 to 8, the month wheel 3 has been prepositioned such that the month display member 30 can indicate the display corresponding to the month of the first date indicated by the member 10. By way of example, FIG. 8 depicts the configuration of the calendar system at the date of the first of December. In this configuration, the wearer of the watch is informed of the current month on the first of each month, notably for the purpose of setting the calendar system if required.

Figure 9:
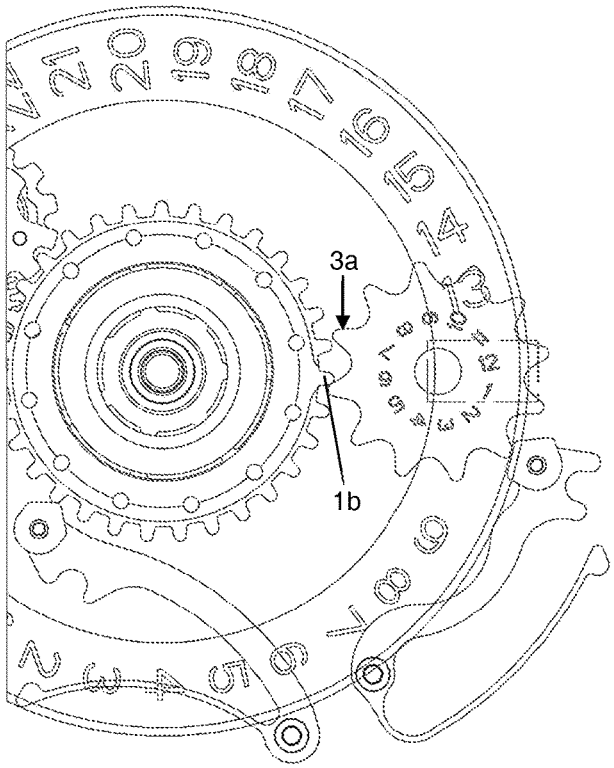
Figure 10:
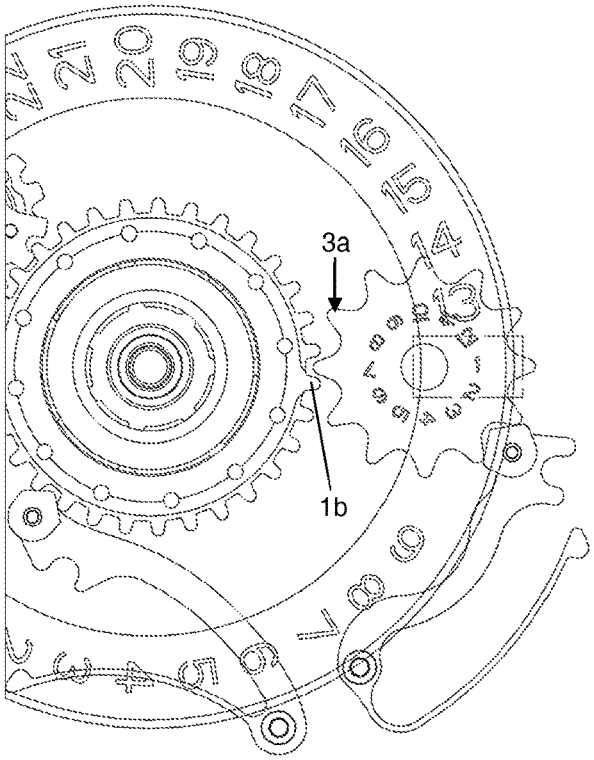

Actuation of the month wheel 3 is performed during the course of the month when the tooth 1*b* acts on the toothset 3*a*, more particularly during the transition from the eleventh to the twelfth day of a current month, as illustrated in FIGS. 9 and 10. For the sake of clarity, the dates "10", "11" and "12" are not indicated on the date display disk 10. Advantageously, the movement of the month display member 30 cannot be seen by the wearer of the watch given that the opening 10*a* is not positioned in the second aperture 4 of the dial 99. Thus, according to this embodiment, from the twelfth day of a current month onwards, the month wheel 3 is positioned in such a way that the month display member 30 can indicate the month to come, as depicted in FIG. 10. Accordingly, a drive element 1 for driving the month wheel is arranged in such a way that the month wheel or the month display member is driven while the month display member and/or the opening 10*a* is not visible to the user. In particular, the drive element is arranged in such a way that the month wheel or the month display member is driven between the second and the thirtieth day of the month indicated by the calendar system, particularly between the tenth and the twentieth day of the month indicated by the calendar system.

For preference also, the drive element for driving the month display member is arranged so as to drive the month display member by one step while the date display member is driven by one step.

The drive element is advantageously the date wheel. It comprises at least one tooth 1*b* meshing with several teeth 3*a* of the month wheel 3, particularly one tooth 1*b* meshing with twelve teeth 3*a* of the month wheel 3.

Such an embodiment makes it possible to use a simplified date wheel provided only with two separate levels for setting out the toothsets 1*a*, 1*b*. This also results in a design that is more compact, with the calendar module thickness minimized. Alternatively, the toothset 1*b* could be arranged on the same level as the toothset 1*a* by using a geometry of the toothset 1*b* that differs from that of toothset 1*a*.

A second embodiment of a timepiece 220 is described hereinafter with reference to FIGS. 11 to 15. The timepiece is, for example, a wristwatch.

The timepiece may comprise a horology movement 210, notably a mechanical movement.

The horology movement comprises a second embodiment of a calendar system 200 according to the invention. Advantageously, the calendar system is of the annual date or even perpetual date type.

The horology calendar system 200 comprises:

a date display member 10 comprising an opening 10*a*, and a month display member 30 arranged in such a way as to display an indication of the month in the opening 10*a*.

Those elements of the first and second embodiments of the calendar system that have the same structure or the same function are referenced by the same numerical symbols.

The first aspect of the invention is also illustrated by the second embodiment described hereinbelow. This second embodiment differs from the first embodiment described above chiefly in that:

the month wheel is driven by one step over several driving steps for driving the date wheel; and/or the date display member and the month display member are pivoted about one and the same axis P, namely coaxially, and/or the date wheel and the month wheel are pivoted about one and the same axis P, namely coaxially.

Figure 11:
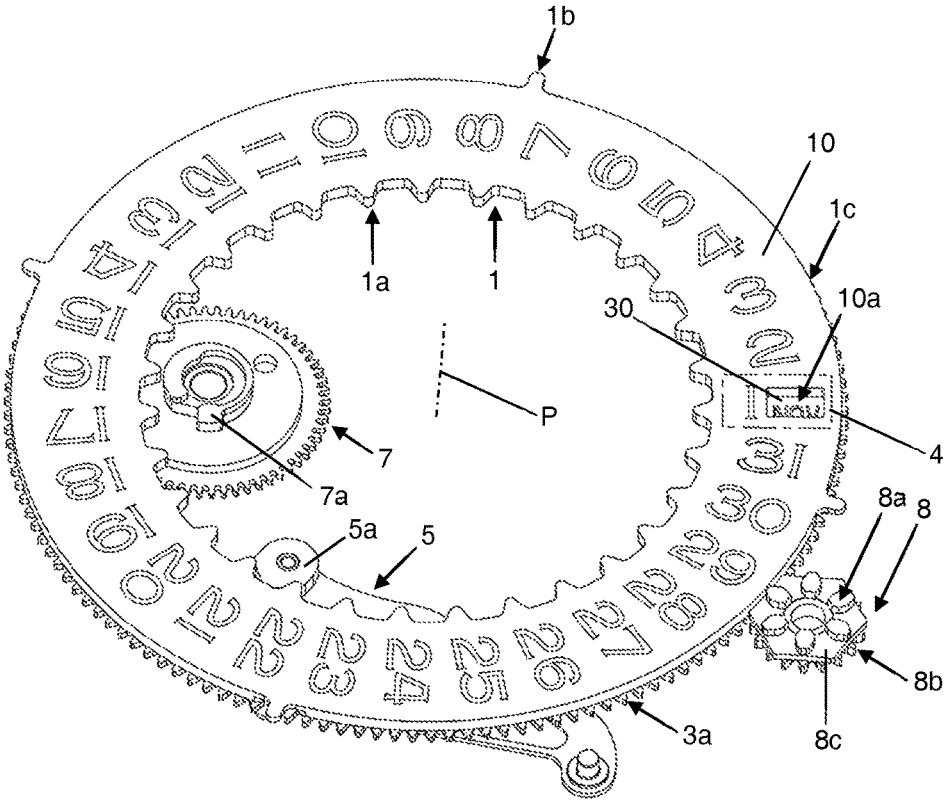
FIGS. 11 to 15 depict a second embodiment of a horology calendar system according to the invention.
Figure 12:
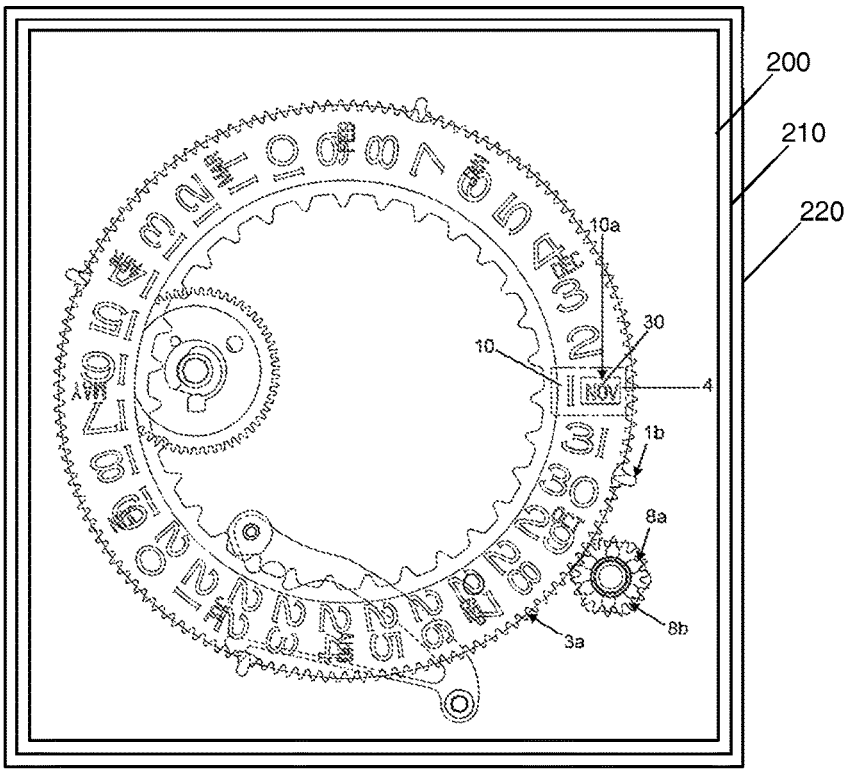
Figure 13:
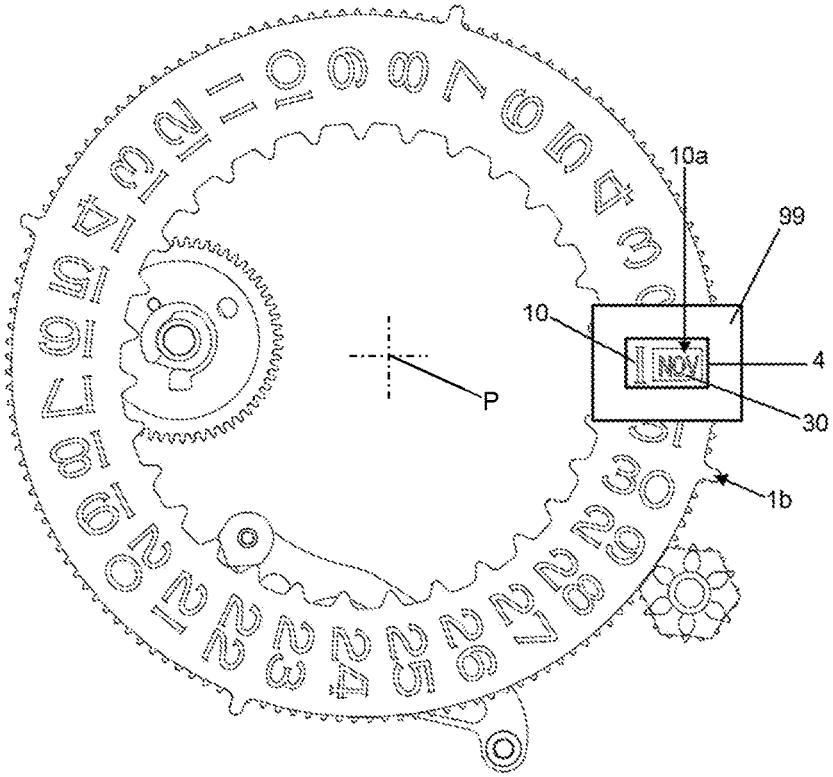

In the second embodiment, the month display wheel is thus actuated over several angular steps of the date disk as depicted in FIGS. 11 to 13. The calendar system notably comprises a kinematic connection element 8 connecting the date wheel and the month wheel. For example, this connection element may be produced in the form of an intermediate wheel or in the form of a system in which one or more intermediate wheels mesh on the one hand with the date wheel, at least over a toothed sector of the date wheel, and mesh on the other hand with the month wheel. During conventional operation of the calendar system, the angular position of the date wheel may be indexed by means of a jumper 5 the beak 5*a* of which is designed to collaborate with a toothset of the date wheel. The angular position of the month wheel 3 is for its part guaranteed, give or take the tooth lash, via the connection element which meshes with the date wheel and the month wheel.

The date wheel 1 has an interior toothset 1*a* designed to be actuated by a date drive finger 7*a*. In the embodiment depicted, the date wheel further comprises a toothset 1*b* arranged at the exterior periphery of the wheel 1 and designed to mesh with a toothset 3*a* of the month wheel 3 via the kinematic connection element 8. The connection element is pivoted about an axis parallel to the axis P.

The connection element 8 may for example comprise a Maltese cross 8 as depicted in FIGS. 11 to 13. The Maltese cross may comprise protrusions 8*a* meshing with n teeth 1*b* of the date wheel. The Maltese cross has a toothset 8*b* meshing with a toothset 3*a* of the month wheel 3. n is preferably a natural integer greater than 1, notably n=2 or n=3 or n=4 or n=5. Thus, the connection element 8 is arranged to drive the month wheel by at most 1/n of a step while the date display member is driven by one step.

In conventional operation of the calendar system, the angular position of the wheel 1 is indexed by means of a jumper 5 the beak 5*a* of which is designed to mesh with the toothset 1*a*. The angular position of the wheel 3 is itself guaranteed, give or take the tooth lash, by an exterior circular periphery 1*c* of the wheel 1 which is designed to engage with a polygonal or substantially polygonal profile 8*c* of the connection element 8. Actuation of the month wheel is performed by meshing of the toothset 1*b* with a toothset 8*a* of the connection element 8 and by meshing of the toothset 8*b* with the toothset 3*a*. Accordingly, during certain steps of the date wheel, the month wheel is driven by at most 1/n of a step and during other steps of the date wheel, the month wheel is not driven.

In the embodiment depicted, the date wheel has four teeth 1*b*. A date jump drives the month wheel 3 over one quarter of its angular step, when a tooth 1*b* interacts with the connection element. However, a jump in date does not cause the month wheel 3 to move when no tooth 1*b* is interacting with the connection element. In other words, the month wheel is actuated over four angular steps of the date disk. For example, these actuations or drives occur when passing from the second to the third day of the month, from the tenth to the eleventh day of the month, from the seventeenth to the eighteenth day of the month and from the twenty-fifth to the twenty-sixth day of the month, which are displayed in the aperture 4 of the dial 99 (depicted partially in FIG. 13). Alternatively, the month wheel 3 may be actuated over the entire month, namely over thirty-one angular steps of the date wheel, thanks to a suitable structure of the date wheel, of the month wheel and of the connection element.

Thus, in this second embodiment, the energy required for the change in month can be distributed over several instantaneous date jumps, and this can be achieved without an additional jumper. The energy devoted to the change in month indication is therefore very low and has no negative impact on the precision of the watch.

As in the first embodiment, the month indication is preferably not visible through the aperture 4 as long as the opening 10*a* formed on the member 10 is not positioned in the aperture 4. In the second embodiment, the opening 10*a* is juxtaposed with the indication of the first date "1" as depicted in FIGS. 11 to 13.

The construction illustrated in FIGS. 11 to 13 also allows the center of the movement to be kept clear so that it can be devoted to displaying a different time or date indication.

Figure 14:
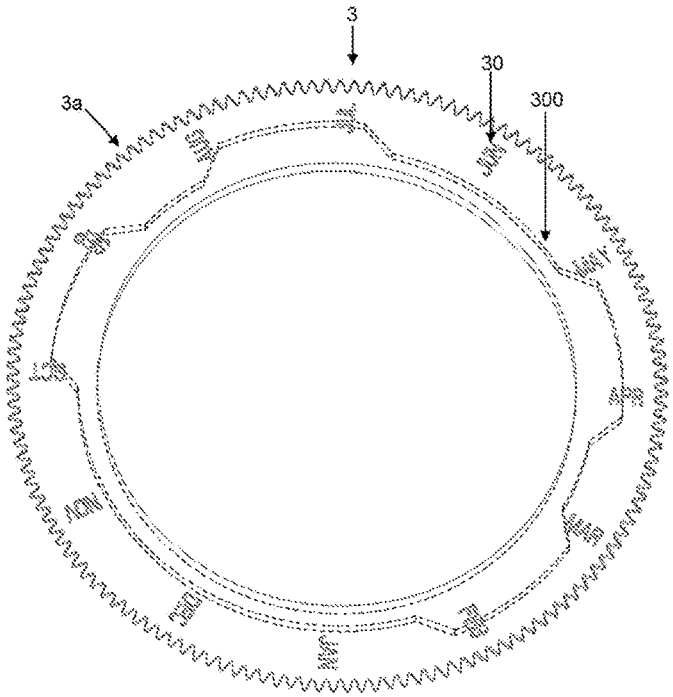
Figure 15:
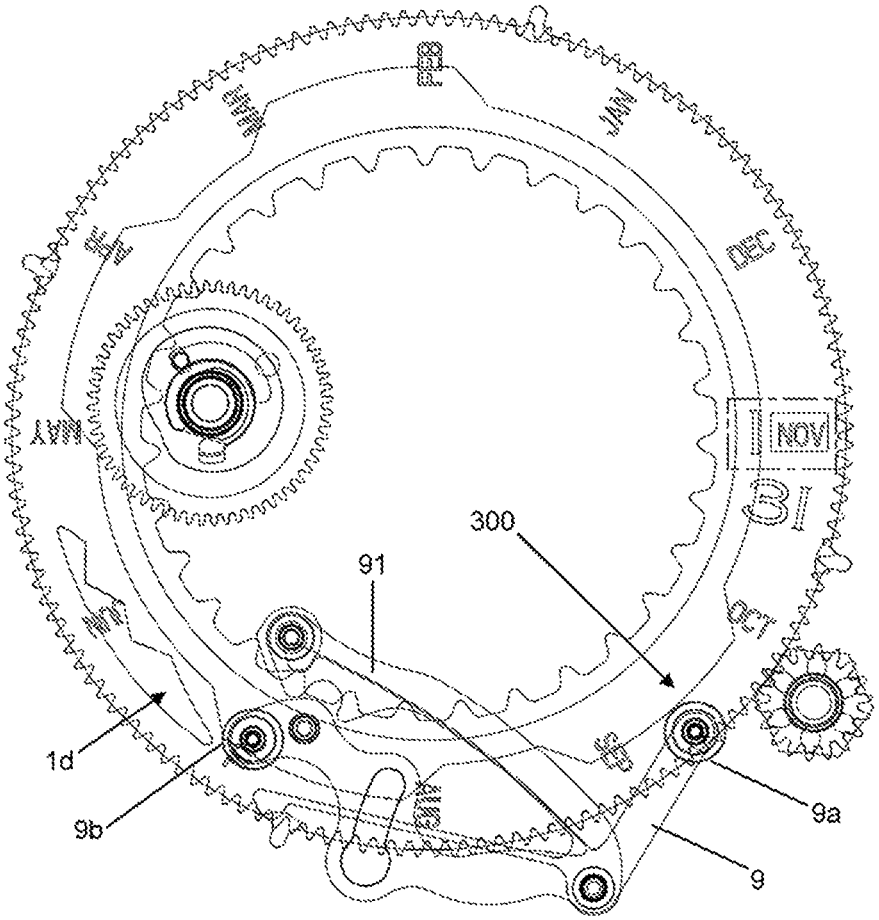

In the various embodiments, the month wheel 3 may be secured to a month cam or programming cam 300 used for programming the annual or perpetual calendar, as illustrated in FIGS. 14 and 15. The cam and the month wheel may form a unitary assembly or be formed as a single component. Alternatively, the cam and the wheel may be attached to one another. Such a construction in which the cam and the month wheel are secured to one another may be particularly beneficial for an annual or perpetual calendar system of which the programming cam, because of the very structure of the system, cannot be actuated during the transition from the thirty-first day of a given month to the first day of the following month. Advantageously, the cam is an annular cam. The month cam may include a member for displaying or indicating the month, particularly a month display disk. Alternatively, the month cam is secured to a member for displaying or indicating the month, particularly a month display disk. The month cam may be provided with a cam surface arranged on the interior or exterior periphery.

Thus, the month display member 30 and the calendar programming cam 300 may be driven simultaneously or together.

By way of example, FIG. 15 depicts a mechanism for indexing the position of the date wheel using a month cam 300 designed to distinguish the short months comprising thirty days at most from the long months comprising thirty-one days. In this mechanism, a date disk indexing and drive lever 9 is controlled in terms of position by the cam 300, via a first roller 9*a* pivoted on the lever, so that a second roller 9*b* pivoted on the lever can be positioned or not in the path of a date disk indexing toothset 1*d*. Thus, when the second roller intercepts the path of the toothset 1*d*, at the end of a short month, the indexing toothset is active and a date disk indexing jumper 91 is not active. It then follows that, when the date wheel is positioned to indicate "30" and a drive finger is acting on the date wheel to drive it, collaboration between the lever and the toothset is such that the next date indicated in a stable manner by the date disk is "1". By contrast, when the second roller does not intercept the path of the toothset 1*d*, at the end of a long month, the indexing toothset 1*d* is not active and the date disk indexing jumper 91 is active. It then follows that, when the date wheel is positioned to indicate "30" and a drive finger acts on the date wheel to drive it, collaboration between the jumper 91 and the toothset 1*a* is such that the next date indicated in a stable manner by the date disk is "31".

In the example illustrated in FIG. 15, the lever 9, designed to collaborate with the cam 300, is pivoted on the movement framework of a horology movement. Alternatively, the lever 9 may for example be pivoted on a horology wheel, for example a date wheel.

In the example illustrated in FIG. 15, the lever 9 is designed to collaborate with a toothset 1*d* of the date wheel. Alternatively, the lever 9 may take the form of a retractable toothset of the date wheel designed to collaborate with an additional driving element of the date wheel.

In the example of FIG. 15, the lever 9 is designed to collaborate with the exterior periphery of the cam 300. Of course, the lever 9 may collaborate with the interior periphery of the cam 300.

Thus, the month cam is arranged in such a way as to define:

- a first state of the calendar system in which, while the date wheel is in a position for indicating the date "30", an action of the drive element 7 of the calendar system causes the date wheel to advance by two steps; and
- a second state of the calendar system in which, while the date wheel is in a position for indicating the date "30", an action of the drive element 7 of the calendar system causes the date wheel to advance by one step.

In other words, the invention also relates to a method of operation of a horology calendar system or of a horology movement or of a timepiece, in which the method comprises the following steps:

- Positioning the month cam in a first position defining a first state of the calendar system in which, while the date wheel is in a position for indicating the date "30", an action of the drive element 7 of the calendar system causes the date wheel to advance by two steps; and
- Positioning the month cam in a second position defining a second state of the calendar system in which, while the date wheel is in a position for indicating the date "30", an action of the drive element 7 of the calendar system causes the date wheel to advance by one step.

According to the second aspect of the invention illustrated by the second embodiment of the calendar system, the horology calendar system 200 preferably comprises:

- the date wheel 1;
- the month cam 300; and
- the kinematic connection element 8 arranged such that the date wheel allows the driving of the motion of the month cam.

For preference, the driving of the motion of the month cam is performed exclusively by the date wheel 1. More particularly, the driving of the motion of the month cam is preferably performed exclusively by the date wheel 1 via the kinematic connection element 8.

As seen earlier, the date wheel may comprise the date display or indicating member, particularly the date display disk.

Likewise, the month wheel may comprise the month display or indicating member, particularly the month display disk.

The kinematic connection element is preferably arranged to allow the driving, notably the exclusive driving, of the month cam by one step, particularly by one twelfth of a revolution, over the course of one month. In particular, the kinematic connection element may be arranged to allow the driving of the month cam by at most 1/n of a step while the date wheel is driven by one step, where n is a natural integer greater than 1, notably n=2 or n=3 or n=4 or n=5.

As seen earlier, the kinematic connection element may comprise an intermediate wheel device meshing with the month cam and meshing with the date wheel.

In the various embodiments, the date wheel and the date display or indicating member may form a unitary assembly or be made as one component. Alternatively, the member and the wheel may be attached to one another. Likewise, the month wheel and the month display or indicating member may form a unitary assembly or be formed as a single component. Alternatively, the member and the wheel may be attached to one another.

In the various embodiments, the opening 10*a* formed on this member 10 may of course consist of a transparent zone of the same member, notably a first transparent zone incorporated within a more extensive translucent or opaque second zone. For a timepiece that has no dial, notably a timepiece of the "skeleton" type, the opening 10*a* is in itself enough to make the month indication visible.

In the various embodiments, indication of the first day of the month "1" or of any other day of the month intended to be displayed with the indication of the month may, moreover, be borne by the month display member 30.

For preference, a calendar system according to the invention is accompanied by a rapid correction system. Such a calendar system may also be provided with a mechanism that allows the opening 10*a* to appear only during the mode for setting the calendar system, for example as a function of the axial position of the adjusting stem used to set the horology movement.

In the various embodiments, the horology calendar system is preferably of the instantaneous-jump type.

In the various embodiments, the date display member and/or the month display member are preferably disks or annular portions of disks. Alternatively, one and/or the other of the display members may comprise a hand intended to collaborate with a limb.

In this document, an interesting embodiment of the kinematic connection element has been disclosed in detail. However, obviously, alternative kinematic connection elements can be used, as previously mentioned above. For example, the kinematic connection element may be any reducing gear system meshing both with the date wheel and with the month cam and the gear wheel of which allows to rotate the month cam by a twelfth of a revolution while the date wheel is rotated by one revolution or more generally which allows to drive the month cam by one step during one month.

The invention claimed is:

1. A horology calendar system comprising:

a date display member comprising an opening; and a month display member arranged so as to display an indication of the month in the opening, wherein the date display member rotates to display the current date of the month, and the month display member rotates to display the current month of the year, wherein the horology calendar system further comprises a drive element for driving the month display member, wherein the drive element comprises a kinematic connection element connecting the date display member to the month display member, wherein the connection element comprises a Maltese cross.

2. The horology calendar system as claimed in claim 1, comprising a drive element for driving the month display member arranged to drive the month display member while at least one of the month display member and the opening is not visible to the user.

3. The horology calendar system as claimed in claim 2, wherein the drive element comprises a date wheel provided with at least one tooth meshing with several teeth of a month wheel.

4. The horology calendar system as claimed in claim 2, wherein the drive element for driving the month display member is arranged to drive the month display member between the second and the thirtieth day of the month indicated by the calendar system.

5. The horology calendar system as claimed in claim 2, wherein the drive element for driving the month display member is arranged to drive the month display member between the tenth and the twentieth day of the month indicated by the calendar system.

6. The horology calendar system as claimed in claim 2, comprising a drive element for driving the month display member arranged to drive the month display member by one step while the date display member is driven by one step.

7. The horology calendar system as claimed in claim 1, comprising a drive element for driving the month display member arranged to drive the month display member by one step while the date display member is driven by one step.

8. The horology calendar system as claimed in claim 1, wherein the connection element is arranged to drive the month display member by at most 1/n of a step while the date display member is driven by one step, where n is a natural integer greater than 1.

9. The horology calendar system as claimed in claim 1, wherein the Maltese cross is provided with projections collaborating with n teeth of a date wheel, the Maltese cross having a toothset meshing with n teeth of a month wheel or wherein the kinematic connection element comprises a device including one or more intermediate wheels meshing with the month cam and meshing with a date wheel.

10. The horology calendar system as claimed in claim 1, wherein at least one of (i) the date display member and the month display member are pivoted about one and the same axis, and (ii) a date wheel and a month wheel are pivoted about one and the same axis.

11. The horology calendar system as claimed in claim 1, wherein at least one of (i) the date display member is a date wheel and (ii) the month display member is a month wheel.

12. The horology calendar system as claimed in claim 1, wherein at least one of the date display member and the month display member are disks or annular portions of disks.

13. The horology calendar system as claimed in claim 1, wherein the horology calendar system comprises a dial equipped with an aperture for displaying the days of the month, in which aperture the opening is arranged to appear.

14. The horology calendar system as claimed in claim 1, wherein the horology calendar system is of the instantaneous jump type.

15. The horology calendar system as claimed in claim 1, wherein at least one tooth of a date wheel is arranged so as to allow an additional jump of the date display member at at least one of (i) the end of a month comprising fewer than thirty days and (ii) the end of a thirty-day month.

16. The horology calendar system as claimed in claim 1, wherein a month wheel comprises a cam for programming an annual or perpetual calendar.

17. A horology movement comprising a system as claimed in claim 1.

18. A timepiece comprising a system as claimed in claim 1.

19. The horology calendar system as claimed in claim 1, wherein the month display member is arranged so as to display the indication of the month in the opening when at least one of (i) the opening is visible to a user of the calendar system and (ii) the calendar system is indicating a given day of a given month.

20. The horology calendar system as claimed in claim 1, wherein the month display member is arranged so as to display the indication of the month in the opening when the calendar system is indicating the first day of a given month.

21. A horology calendar system comprising:

a date display member comprising an opening; and a month display member arranged so as to display an indication of the month in the opening, wherein the date display member rotates to display the current date of the month, and the month display member rotates to display the current month of the year, wherein the horology calendar system further comprises a drive element for driving the month display member arranged to drive the month display member while at least one of the month display member and the opening is not visible to the user, wherein the drive element for driving the month display member is arranged to drive the month display member between the second and the thirtieth day of the month indicated by the calendar system.

22. The horology calendar system as claimed in claim 21, wherein the drive element for driving the month display member is arranged to drive the month display member between the tenth and the twentieth day of the month indicated by the calendar system.

23. The horology calendar system as claimed in claim 21, comprising a drive element for driving the month display member arranged to drive the month display member by one step while the date display member is driven by one step.

* * * * *